US006718667B2

(12) United States Patent
Applebee

(10) Patent No.: US 6,718,667 B2
(45) Date of Patent: Apr. 13, 2004

(54) DEVICE FOR DISPLAYING MESSAGES

(76) Inventor: Steve E. Applebee, 109 Mayfield St., Summerville, SC (US) 29485

( * ) Notice: Subject to any disclaimer, the term of this patent is extended or adjusted under 35 U.S.C. 154(b) by 0 days.

(21) Appl. No.: 09/818,479

(22) Filed: Mar. 27, 2001

(65) Prior Publication Data

US 2002/0139024 A1 Oct. 3, 2002

(51) Int. Cl.[7] ..... G09F 7/00
(52) U.S. Cl. ..... 40/597; 40/488
(58) Field of Search ..... 40/597, 610, 488, 40/491, 490; 211/87.01, 88.02, 50; 312/129

(56) References Cited

U.S. PATENT DOCUMENTS 1,583,720 A * 5/1926 Jacobs ..... 40/739
1,767,726 A * 6/1930 Woerz ..... 40/739
5,096,272 A * 3/1992 Belokin, Jr. et al. ..... 312/129

* cited by examiner

*Primary Examiner*—Cassandra H. Davis
(74) *Attorney, Agent, or Firm*—W. Alex Dallis, Jr.

(57) ABSTRACT

A device for displaying messages, including bumper stickers, which provides for adjusting the horizontal length to allow insertion therein of messages of varying lengths. The device may be removably attached to other surfaces, such as the windows of cars. The device is constructed such that the upper end is open allowing protrusion therethrough of messages of varying heights.

8 Claims, 2 Drawing Sheets

DEVICE FOR DISPLAYING MESSAGES

CROSS REFERENCE TO RELATED APPLICATIONS

None.

STATEMENT REGARDING FEDERALLY SPONSORED RESEARCH AND DEVELOPMENT

None.

BACKGROUND OF THE INVENTION

1. Field of the Invention

The present invention relates to a device for displaying messages, including bumper stickers. The invention includes means of adjusting the horizontal length to allow insertion therein of messages of varying lengths. The invention also includes means of removably attaching the device to other surfaces, such as the windows of cars. The invention is constructed such that the upper end is open allowing protrusion therethrough of messages of varying heights.

2. Description of the Related Art

Typically messages such as bumper stickers are affixed to surfaces of objects such as cars by means of adhesive. This method has the disadvantage of not allowing readjustment without possibly destroying the message item. Additionally this method requires substantial time in application in order to ensure correct placement, since readjustment is not possible. This method also requires that messages be placed for a long-term presence, since removal results often in destruction of the message item itself. Finally, this method may cause damage to the surface to which the message is affixed, since the adhesive may be difficult to remove or may cause coatings on the surface to be removed with it.

Alternative methods of affixing messages to surfaces are disclosed by various patents a more complete treatment of which appears in U.S. Pat. No. 5,241,768 to Thompson. The Thompson patent teaches a message holder which may be removably attached to surfaces such as car windows. Such device does allow insertion therein of messages such as bumper stickers, but such device is not adjustable. As a result of the lack of adjustability, the device disclosed by U.S. Pat. No. 5,241,768 is limited in use to messages having a certain length and no more. The Thompson device further includes a full face plate. The existence of this face plate over the message may obscure the message, since such plate may be scratched or otherwise damaged. Additionally provision of this face plate increases the material needed to construct the Thompson device, increasing its cost and its weight. Finally, the existence of the face plate in the Thompson device makes insertion and extraction of the message into or from the device more difficult than if such face plate were not present.

U.S. Pat. No. 1,767,726 to Woerz also discloses a sign with length adjustment. Woerz discloses and claims both upper and lower walls which do not allow use therein of messages having varying heights. Additionally, Woerz includes in its claims the individual character plates specifically configured to engage the lower and upper walls, thus limiting its use to messages specifically using the claimed character plates.

U.S. Pat. No. 1,583,720 to Jacobs adds to Woerz the use of suction cups for attaching an adjustable sign to a support surface. As with Woerz, Jacobs teaches an adjustable sign which includes a top member into which the letters used for the message must be inserted. As with Woerz, Jacobs claims not only the hollow rails into which transparent panels fit, but also the transparent panels themselves. Again, the Jacobs device is only usable with specific panels made for the device. Neither Woerz nor Jacobs could be used for insertion therein of messages of varying heights or messages made from material not specifically manufactured to fit into the Woerz or Jacobs devices.

BRIEF SUMMARY OF THE INVENTION

It is the object of the present invention to provide a device which improves the current art by being adjustable to allow insertion therein of messages of any length whatsoever. It is further an object of the instant invention to require no face plate, thus advancing the existing art by decreasing cost of construction, decreasing weight, ensuring long-lasting clear visibility of the message inserted therein and ease of insertion and removal of the message. It is further an object of the Applicant's invention to remove any top member from the display device such that messages of any height may be inserted therein, again increasing the ease of use of the device and decreasing the cost and weight of such device and obviating any need for messages to be custom sized for use with the device. Finally, it is a further object of the Applicant's invention to allow construction of the device using transparent material to ensure clear visibility not only of the message, but also to ensure that when message are not present in the device the device need not be removed to allow vision through the device, particularly if the device is used on windows of vehicles. These substantial differences between the prior art and Applicant's invention create a substantial enhancement of the existing art.

BRIEF DESCRIPTION OF THE DRAWINGS

The objects and features of the invention may be further understood with reference to the following detailed description of an illustrative embodiment of the invention taken together with the accompanying drawings in which.

DETAILED DESCRIPTION

Figure 1:
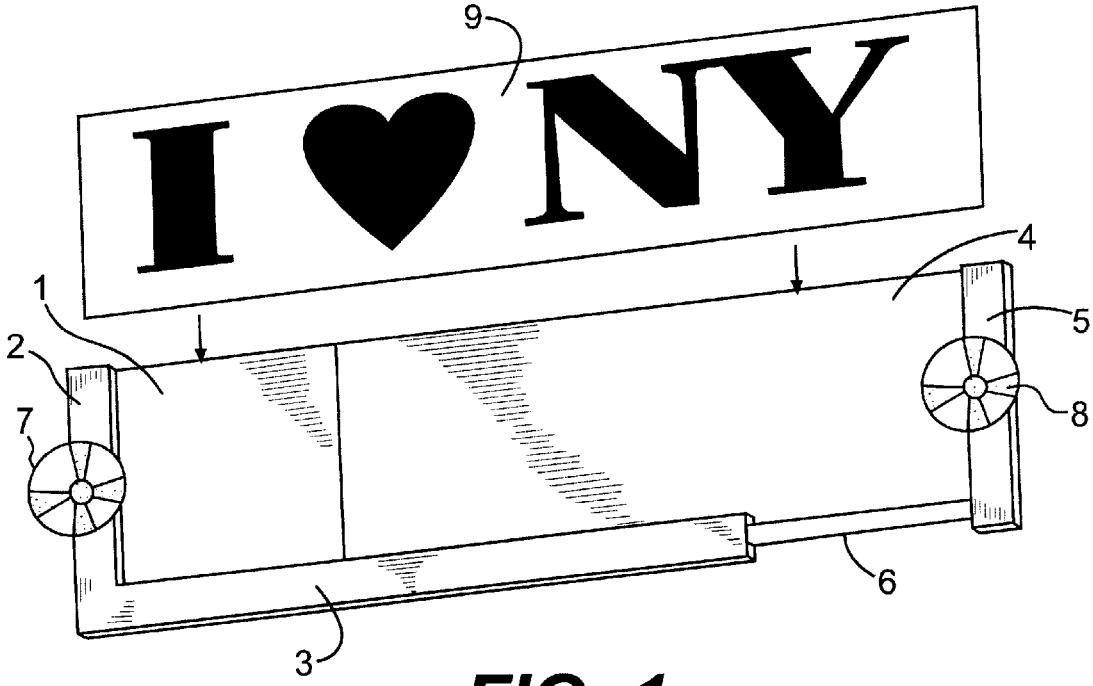
FIG. 1 shows an isometric view of the entire device.

Turning now descriptively to the drawings in which similar reference characters denote similar elements throughout the several views, FIG. 1 shows a message 9 being inserted into the device, which is comprised of a left back plate 1 to which is attached on the left side a left end brace 2. Along the bottom of said left back plate 1 is attached a bottom channel 3. There is defined in said bottom channel 3 an opening through which may be inserted a bottom rod 6. Said bottom rod 6 is attached at its right end to the bottom of a right end brace 5. In turn said right end brace 5 is attached to a right back plate 4. To the front of said left end brace is attached left window attaching means 7, here shown as a suction cup. To the front of said right end brace 5 is attached a right window attaching means 8, here shown as a suction cup.

Figure 2:
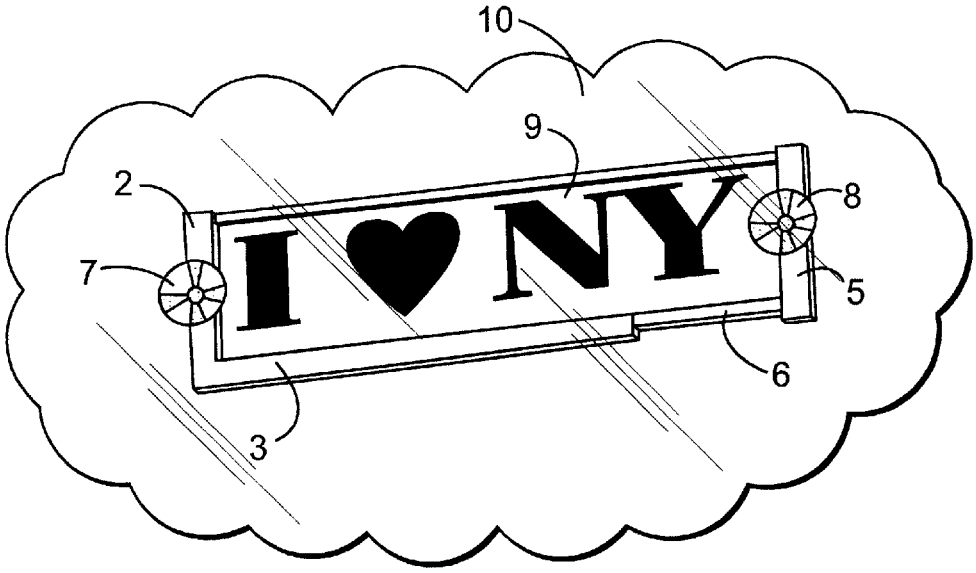
FIG. 2 shows an isometric view of the entire device through a window to which the device is attached.

FIG. 2 shows the device attached to a window 10 by attaching to said window 10 said left window attaching means 7 and said right window attaching means 8. This figure shows how said message 9 is seen through said window 10 through use of the device.

Figure 3:
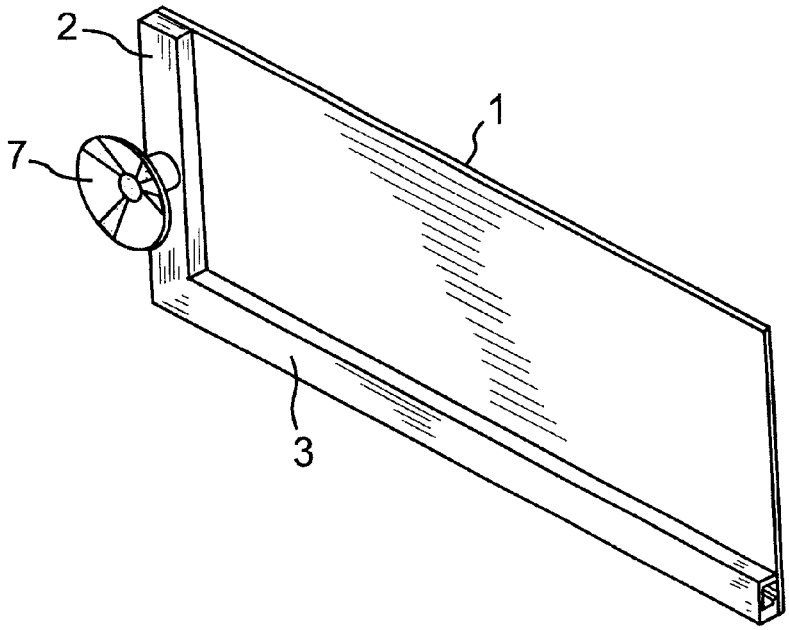
FIG. 3 shows an isometric view of the left half of the device.
Figure 4:
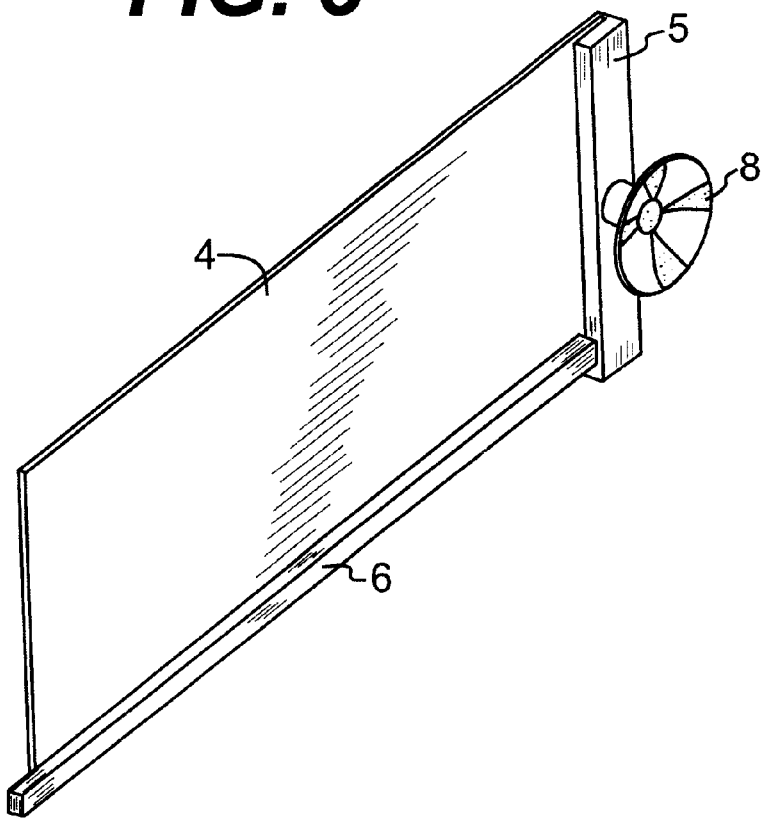
FIG. 4 shows an isometric view of the right half of the device.

FIG. 3 shows how said left back plate 1 attached to said left end brace 2 and said bottom channel 3 can be removed from the remainder of the device. FIG. 4 shows how said right back plate 4 attached to said right end brace 5 and said bottom rod 6 appears when the left half of the device has been removed. Together FIG. 3 and FIG. 4 show how the opening formed by said bottom channel 3 and said left back plate 1 can allow insertion therethrough of said bottom rod 6 to allow the entire device to be adjustable lengthwise to allow insertion therein of messages of varying lengths.

While I have described and illustrated certain embodiments of my invention, it is to be understood that further modifications and improvements are contemplated and may be practiced without departing in any way from the spirit of the invention, for the limits of which reference must be had to the appended claims.

I claim:

1. A device for displaying messages, having an open top and an open face, which comprises:

a. a left back plate, roughly rectangular in shape having a top edge, a bottom edge, a left edge and a right edge;

b. a left end brace roughly rectangular in cross-section, having a front, a back, a top, a bottom, a left side and a right side, permanently affixed along its back to said left back plate and extending vertically along the left edge of said left back plate from the top edge of said left back plate to the bottom edge of said left back plate, between said left end brace and said left back plate is defined a slot extending vertically from the top of said left end brace to the bottom of said left end brace and extending from horizontally from the right side of said left end brace no more than partially through said left end brace;

c. a bottom channel, roughly U-shaped, said bottom channel comprising a roof wall, a side wall and a floor wall such that there is defined opposite said side wall an open face for the entire length of said bottom channel which said open face faces the left back plate, said bottom channel being permanently affixed along said floor wall to said left back plate along said left back plate's bottom edge and extending horizontally from said left end brace to the right edge of said left back plate, between said roof wall of said bottom channel and said left back plate there being defined a slot extending along the entire length of said bottom channel;

d. a right back plate, roughly rectangular in shape having a top edge, a bottom edge, a left edge and a right edge;

e. a right end brace roughly rectangular in cross-section, having a front, a back, a top, a bottom, a left side and a right side, permanently affixed along its back to said right back plate and extending vertically along the right edge of said right back plate from the top edge of said right back plate to the bottom edge of said right back plate, between said right end brace and said right back plate is defined a slot extending vertically from the top of said right end brace to the bottom of said right end brace and extending horizontally from the left side of said right end brace no more than partially through said right end brace;

f. a bottom rod of such dimension and cross-section as to protrude through said bottom channel, said rod being permanently affixed to the bottom of said right end brace and extending therefrom perpendicularly such that when said rod is inserted into said bottom channel, said right back plate lies in front of said left back plate; and g. means for removably attaching both said left end brace and said right end brace to a surface.

2. A device for displaying messages as recited in claim 1, wherein means for removably attaching both said left end brace and said right end brace to a surface comprise a plurality of suction cups attached to the front of said left end brace and the front of said right end brace.

3. A device for displaying messages as recited in claim 2, wherein said suction cups number two and one of which each is attached to the front of both said left end brace and said right end brace at approximately the vertical midpoint of said left end brace and said right end brace.

4. A device for displaying messages as recited in claim 3, wherein the device is made entirely from transparent material.

5. A device for displaying messages as recited in claim 1, wherein said bottom channel and said rod both are roughly rectangular in cross-section and said side wall of said bottom channel is flush with the front of both said left end brace and said right end brace.

6. A device for displaying messages as recited in claim 5, wherein means for removably attaching both said left end brace and said right end brace to a surface comprise a plurality of suction cups attached to the front of said left end brace and the front of said right end brace.

7. A device for displaying messages as recited in claim 6, wherein said suction cups number two and one of which each is attached to the front of both said left end brace and said right end brace at approximately the vertical midpoint of said left end brace and said right end brace.

8. A device for displaying messages as recited in claim 7, wherein the device is made entirely from transparent material.

* * * * *